United States Patent [19]

Colapinto

[11] 4,408,400

[45] Oct. 11, 1983

[54] METHOD OF AND APPARATUS FOR DRYING FRESHLY PRINTED SHEETS AND OTHER SUBSTRATES BY INFRARED OR ULTRAVIOLET RADIATION

[75] Inventor: Fabio Colapinto, Milan, Italy

[73] Assignee: Argon Industrie Meccaniche s.r.l., Milan, Italy

[21] Appl. No.: 307,960

[22] Filed: Oct. 2, 1981

[30] Foreign Application Priority Data

Oct. 16, 1980 [IT] Italy ..... 25378 A/80

[51] Int. Cl.[3] ..... F26B 3/30

[52] U.S. Cl. ..... 34/4; 34/41; 34/151; 118/642; 118/643; 250/495.1

[58] Field of Search ..... 34/4, 41, 151; 118/641, 118/642, 643; 250/492.1, 494, 495

[56] References Cited

U.S. PATENT DOCUMENTS 3,645,228 2/1972 Schmidt ..... 118/642

*Primary Examiner*—Larry I. Schwartz

*Attorney, Agent, or Firm*—Karl F. Ross

[57] ABSTRACT

Individual sheets, webs drawn from rolls or other substrates coming from a screen printer are dried in an oven in which they are irradiated by one or more lamps moving codirectionally with the substrates but at a lesser speed to establish a predetermined relative velocity. With intermittently advancing substrates the lamps are moved during standstill of the substrate in the reverse direction at the same relative speed as during forward motion. The substrate travel along a horizontal support cooled from below to prevent overheating and may also be subjected to a flow of hot air serving to accelerate drying.

10 Claims, 11 Drawing Figures

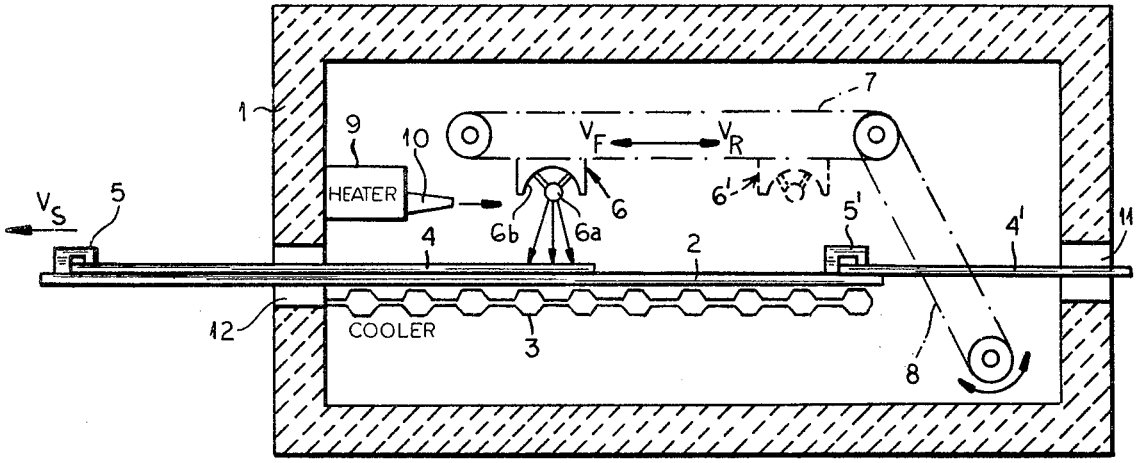
FIG.1
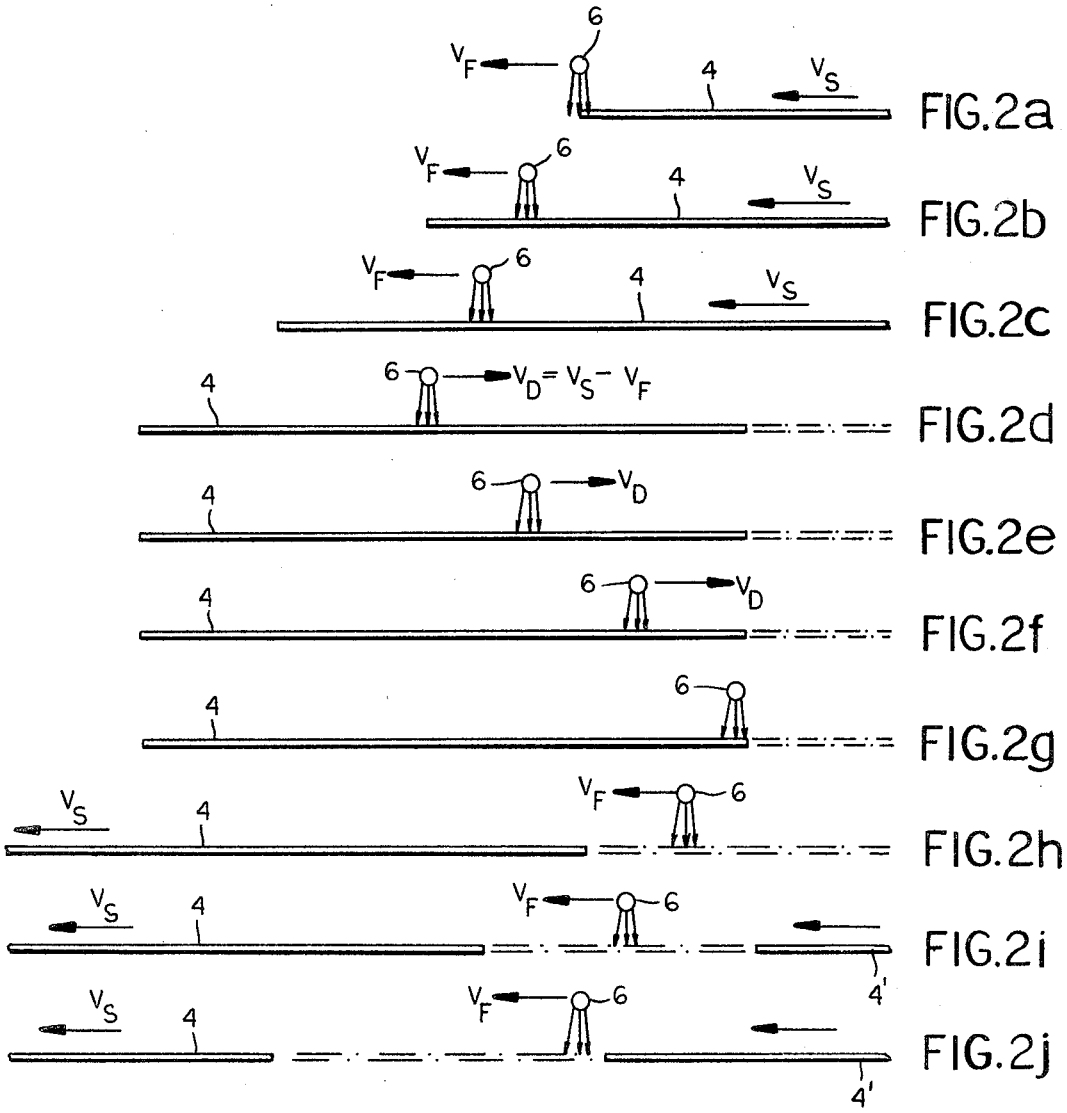
FIG.2a
FIG.2b
FIG.2c
FIG.2d
FIG.2e
FIG.2f
FIG.2g
FIG.2h
FIG.2i
FIG.2j

METHOD OF AND APPARATUS FOR DRYING FRESHLY PRINTED SHEETS AND OTHER SUBSTRATES BY INFRARED OR ULTRAVIOLET RADIATION

FIELD OF THE INVENTION

My present invention relates to a method of and an apparatus for drying freshly printed substrates of sheet material coming from a screen printer. The term "substrate", as herein used, encompasses both individually printed sheets and printed sections of a continuous web drawn from a roll, for example.

BACKGROUND OF THE INVENTION

Present-day screen printers operate quite rapidly and thus turn out printed sheets or web sections at a fast rate. For efficient operation, that rate must be matched by the throughput of a drying oven to which the freshly inked substrates are delivered and which they must leave in a state suitable for stacking or coiling, as the case may be. An advantageous type of drying oven is equipped with one or more sources of radiant energy, generally infrared or ultraviolet radiation, which for simplicity will be referred to hereinafter as lamps. Uniform drying requires that the inked substrate should move at consant speed past a lamp or row of lamps extending across its full width, the lamp or lamps irradiating at any instant a well-defined zone of the sheet. The time exposure of an elemental area of the substrate to the infrared or ultraviolet rays is determined by the extent of the irradiated zone in the direction of sheet motion and is inversely proportional to the speed of that substrate. With a given average ink density, therefore, the required minimum drying time imposes a limit on the speed of travel of the substrate through the oven. The exposure time can be foreshortened by enhancing the power of the lamp or lamps, yet this is risky since it may cause overheating of the more sparsely inked areas and may thus deform the substrate or otherwise damage the print.

OBJECTS OF THE INVENTION

Thus, an object of my present invention is to provide a method of accelerating the traverse of a drying oven by a freshly printed substrate under otherwise equal conditions in order to enable an increase in the output of a screen printer.

A related object is to provide an apparatus for carrying out this method.

SUMMARY OF THE INVENTION

In accordance with my present invention, a prined substrate surface traversing a heating chamber is irradiated by a mobile souce of radiant energy which moves codirectionally with the advancing substrate but at a lesser speed along a predetermined path, the relative velocity of the source and the substrate being consistent with the rate of radiation required for drying the print on the substrate surfaces during the time available for such a traverse.

According to another aspect of my invention, an apparatus for practicing the method just described comprises a heating chamber provided with guide means forming a predetermined path for the substrate to be dried, feed means for successively advancing the substrate along that path through the heating chamber at a predetermined first speed, a mobile source of radiant energy positioned to irradiate a printed surface of a substrate engaged by the feed means, and drive means coupled with the source for moving same co-directionally with the substrate irradiated thereby along the aforementioned path at a predetermined second speed less than the first speed to establish the requisite relative velocity.

Conventional sheet feeders include continuously moving conveyors with clamps gripping a sheet coming from a screen printer and entraining it without interruption through an adjoining heating chamber. In such a system a lamp irradiating that sheet is to be aligned with its leading edge just after it enters the chamber and, after passing its trailing edge, is to be returned to its starting position in time for meeting another oncoming sheet. Advantageously, such a return takes place at a higher speed than the forward motion of the lamp in order to reduce the spacing required between successive sheets. Such an accelerated return, however, will not be necessary if another lamp is available to irradiate the next sheet in the same manner.

Situations exist, as where the substrates to be dried are part of a continuous web drawn from and/or wound up on a roll, in which it is necessary to arrest a substrate being dried while another one is being printed. Such an intermittent advance will also take place when the sheets are transported by a reciprocating feed mechanism rather than by a unidirectionally moving conveyor. In these cases my invention provides for a reversal of the lamp motion during standstill of the substrate in the heating chamber so as to maintain the same relative velocity between the lamp and the sheet for a uniform irradiation of the entire printed surface.

I may foreshorten the requisite drying time and/or reduce the needed power of the source of radiation by subjecting the printed sheet surfaces in the heating chamber to a flow of hot air. The use of hot-air jets for the drying of screen-printed sheets has already been disclosed in my prior U.S. Pat. No. 3,911,593 according to which, however, the sheets are individually loaded onto alternately ascending and descending trays.

BRIEF DESCRIPTION OF THE DRAWING

The above and other features of my invention will now be described in detail with reference to the accompanying drawing in which:

FIG. 1 is a sectional elevational view of a drying oven forming part of an apparatus according to my invention; and FIGS. *2a–2j* diagrammatically illustrate successive stages in the irradiation of a sheet advancing intermittently through the drying oven of FIG. 1.

SPECIFIC DESCRIPTION

In FIG. 1 I have shown a drying oven 1 with an entrance slot 11 and an exit slot 12 for freshly inked sheets 4, 4' arriving successively from a nonillustrated screen printer. The sheets, engaged at their leading edges by clamps 5, 5' of an otherwise nonillustrated conventional transporter, move from right to left at a constant speed $V_S$ over a horizontal guide path defined by a stationary supporting plate 2. A heat exchanger 3, e.g. a radiator of the type described in my copending application Ser. No. 236,115 filed Feb. 19, 1981 and now abandoned, underlies the support plate 2 in order to cool the unprinted undersides of the passing sheets for the purpose of preventing any overheating. The oven 1 also contains a heater 9 with nozzles 10 emitting jets of hot air to accelerate the drying of the sheets as discussed above.

A source of infrared or ultraviolet radiation, shown as a lamp 6 with a tubular bulb 6*a* and a parabolic reflector 6*b*, is mounted above the support plate 2 on a chain conveyor 7 which is driven from a nonillustrated motor via a transmission 8. Lamp 6 irradiates a limited zone of the underlying sheet 4 which it trails at a conveyor speed $V_F$ codirectional awith sheet speed $V_S$; thus, the sheet 4 moves at a differential speed $V_D=V_S-V_F$ relatively to lamp 6. When the zone of irradiation has reached the trailing edge of sheet 4, the direction of motion of conveyor 7 is reversed to let the lamp 6 return at a preferably higher speed $V_R$ to a starting position 6' (indicated in phantom lines) in which it is able to irradiate the newly arriving sheet 4'. As soon as the leading edge of the latter sheet moves past the lamp, the conveyor 7 resumes its previous sense of rotation whereby the second sheet is irradiated in the same manner as the first one during its traverse of oven 1. As will be readily apparent, any elemental area of the printed sheet surface is irradiated for a longer period than it would be if the sheet traveled at the same speed $V_S$ past a stationary lamp.

Instead of periodically reversing the conveyor 7 and its transmission 8, I could mount additional lamps on that conveyor (including one occupying the phantom-line position 6') at equispaced points so that a new lamp would meet the next oncoming sheet entering through slot 11. In this case the inactive lamp or lamps would be carried on the upper run of the unidirectionally moving conveyor 7 and would ineffectually illuminate the roof of oven 1 unless disconnected from power in that position.

In FIGS. 2*a*–2*j* I have schematically illustrated the manner in which the apparatus of FIG. 1 can be operated if the sheet motion is intermittent, as where substrates 4 and 4' are sections of a continuous web (indicated in dot-dash lines) whose trailing portion traverses the associated screen printer. FIG. 2*a* represents the starting position of lamp 6 as it overlies the leading edge of the oncoming sheet 4, the lamp and the sheet moving as before at their respective speeds $V_F$ and $V_S$. In FIG. 2*b* the sheet 4 and the lamp 6 have advanced, the lamp now overlying an intermediate part of the forward half of sheet 4. FIG. 2*c* shows a further stage, with the position of the lamp nearing the midpoint of the sheet. In FIG. 2*d* the sheet 4 has been halted by its nonillustrated transporter just as the lamp 6 has come to rest above its center, the motion of the lamp being then immediately reversed so that the lamp now moves backward at the aforementioned relative velocity $V_D=V_S-V_F$. This motion continues as long as the sheet is stationary, with the lamp 6 progressively approaching the trailing edge of sheet 4 as shown in FIGS. 2*e* and 2*f*. In FIG. 2*g* the lamp 6 crosses that trailing edge; with the sheet 4 now resuming its advance at speed $V_S$, the lamp 6 begins again to move forward at the lesser speed $V_F$ as seen in FIG. 2*h*. In FIG. 2*i* the next sheet 4' is about to enter the heating chamber of the oven 1 (FIG. 1) so that its leading edge reaches the zone of illumination at the same time when, according to FIG. 2*j*, lamp 6 is in the same starting position as in FIG. 2*a*.

By way of example, the sheet speed $V_S$ (whether continuous or intermittent) may be 60 meters per minute, with $V_F=20$ m/min and $V_D=40$ m/min; the return speed $V_R$ described with reference to FIG. 1 may also be 40 m/min, for example. Thus, the sheets traverse the heating chamber in two-thirds of the time that would be required under otherwise equal conditions with a conventional drying oven using one or more stationary lamps.

If the quantity of ink per sheet or printed web section is changed, the effective exposure time can be correspondingly adjusted by simply varying the speed of conveyor 7 without modifying the operating rate of the screen printer or the transport speed $V_S$.

Reference may be made to my copending application Ser. No. 142,984 filed Apr. 23, 1980, now U.S. Pat. No. 4,305,331, which discloses an intermittently operating conveyor that could be used for transporting individual sheets 4, 4' through a screen printer and an adjoining drying oven forming part of a system such as that schematically represented in FIG. 2. The conveyor drive could be coupled electrically or mechanically with the transmission 8 of FIG. 1 in order to synchronize the motion of lamp 6 with the advance and standstill of the sheets.

I claim:

1. A method of drying freshly printed substrates of sheet material successivly advancing along a predetermined path through a heating chamber, comprising the step of irradiating a printed surface of a substrate traversing said chamber by a source of radiant energy tracking the advancing substrate along said path, with a substantially constant relative velocity consistent with the rate of irradiation required for drying the print on said surface during the time available for a traverse of said chamber.

2. A method as defined in claim 1 wherein the advance of the substrate through said chamber is intermittent, comprising the further step of reversely moving said source across part of the arrested substrate at a speed equaling said relative velocity.

3. A method as defined in claim 1 wherein said source is returned to a starting position near an entrance end of said path at an increased rearward speed between irradiations of consecutive substrates.

4. A method as defined in claim 1, 2 or 3 wherein said relative velocity is between one-half and three-quarters of the forward speed of the substrate.

5. A method as defined in claim 1, 2 or 3 wherein the substrate is cooled on its side opposite its printed surface during passage along said path.

6. A method as defined in claim 1, 2 or 3 wherein the printed surface of the substrate is subjected to a flow of hot air during passage along said path.

7. An apparatus for drying a succession of freshly printed substrates of sheet material, comprising:

a heating chamber provided with guide means forming a predetermined path for said substrates;

feed means for successively advancing said substrates along said path through said chamber;

a mobile source of radiant energy positioned to irradiate a printed surface of a substrate engaged by said feed means; and drive means coupled with said source for moving jointly with a substrate irradiated thereby along said path with a substantially constant relative velocity consistent with the rate of irradiation required for drying the print on said surface during the time available for a traverse of said chamber.

8. An apparatus as defined in claim 7 wherein said feed means operates intermittently, said drive means being reversible to move said source backward across part of the arrested substrate at a speed equaling said relative velocity.

9. An apparatus as defined in claim 7 or 8 wherein said guide means comprises a horizontal support provided with cooling means.

10. An apparatus as defined in claim 7 or 8, further comprising blower means in said chamber generating a flow of hot air across the printed surface of a substrate passing over said path.

* * * * *